US011964792B2

(12) United States Patent
Zimmer et al.

(10) Patent No.: US 11,964,792 B2
(45) Date of Patent: Apr. 23, 2024

(54) BOTTLE WITH GRIP PORTION

(71) Applicant: SOCIETE DES PRODUITS NESTLE S.A., Vevey (CH)

(72) Inventors: Johannes Zimmer, Lausanne (CH); Nicolas Dabrowski, Vittel (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 17/056,821

(22) PCT Filed: May 2, 2019

(86) PCT No.: PCT/EP2019/061172

§ 371 (c)(1),
(2) Date: Nov. 19, 2020

(87) PCT Pub. No.: WO2019/228741

PCT Pub. Date: Dec. 5, 2019

(65) Prior Publication Data

US 2021/0214114 A1 Jul. 15, 2021

(30) Foreign Application Priority Data

May 31, 2018 (EP) ..... 18175332

(51) Int. Cl.
*B65D 1/02* (2006.01)
*B65D 1/42* (2006.01)
*B65D 23/10* (2006.01)

(52) U.S. Cl.
CPC ..... *B65D 1/0223* (2013.01); *B65D 1/42* (2013.01); *B65D 23/102* (2013.01); *B65D 2501/0036* (2013.01)

(58) Field of Classification Search
CPC ..... B65D 1/0223; B65D 23/102; B65D 2501/0036; B65D 1/42
USPC ..... 215/384, 383, 385, 379
See application file for complete search history.

(56) References Cited

U.S. PATENT DOCUMENTS 4,143,784 A * 3/1979 Frahm ..... B65D 85/302 220/675
D582,779 S * 12/2008 Bourne ..... D9/520
D635,461 S * 4/2011 Inoi ..... D9/557
8,567,625 B2 * 10/2013 Nemoto ..... B65D 1/0284 215/398
9,434,499 B2 9/2016 Boulay et al.
(Continued)

FOREIGN PATENT DOCUMENTS

EP 1468930 A1 * 10/2004 ..... B29C 49/0042
JP 2012066833 4/2012

*Primary Examiner* — Rafael A Ortiz
*Assistant Examiner* — Sanjidul Islam
(74) *Attorney, Agent, or Firm* — K&L Gates LLP

(57) ABSTRACT

The invention concerns a container (40), preferably a bottle, presenting a longitudinal axis comprising —a neck portion (42), —a shoulder portion (44) connected to the neck portion (42), —a body portion (45) comprising a label portion (46) and a grip portion (48) and connected to the shoulder portion (44) via a first connecting portion (49*a*), the label portion (46) and the grip portion (48) being connected together via a second connection portion (49*b*), and —a base portion (50) forming the bottom of the container (40) connected to the body portion via a third connecting portion (49*c*), wherein the grip portion (48) comprises at least one undulating bead (54).

15 Claims, 9 Drawing Sheets

(56) References Cited

U.S. PATENT DOCUMENTS

| | | | | |
|---|---|---|---|---|
| 9,957,077 | B2 * | 5/2018 | Dornbach | B65D 1/0261 |
| 2007/0257003 | A1 * | 11/2007 | Colloud | B65D 1/0223 215/370 |
| 2010/0230378 | A1 * | 9/2010 | Colloud | B65D 1/0223 215/384 |
| 2013/0334254 | A1 * | 12/2013 | Rose | B67D 3/0061 222/175 |
| 2015/0008210 | A1 * | 1/2015 | Oshino | B65D 1/44 215/373 |
| 2015/0314906 | A1 * | 11/2015 | Kira | B65D 23/102 206/524.6 |
| 2015/0314907 | A1 | 11/2015 | Kira et al. | |
| 2016/0297557 | A1 * | 10/2016 | Zeboudj | B65D 1/0223 |
| 2016/0311570 | A1 * | 10/2016 | Didier | B65D 1/0223 |

* cited by examiner

BOTTLE WITH GRIP PORTION

CROSS REFERENCE TO RELATED APPLICATIONS

The present application is a National Stage of International Application No. PCT/EP2019/061172, filed on May 2, 2019, which claims priority to European Patent Application No. 18175332.8, filed on May 31, 2018, the entire contents of which are being incorporated herein by reference.

FIELD OF THE INVENTION

The present invention relates to containers.

More specifically, the present disclosure relates to lightweight containers having improved stability as well as side-load and top-load resistance and comprising an improved grip portion.

BACKGROUND

Currently, the market comprises many different shapes and sizes of containers capable of housing fluids. The shape and size of fluid containers can depend, among other things, on the amount of fluid to be housed, the type of fluid to be housed, consumer demands and desired aesthetics. For example, thermoplastic containers for beverages are known in the art. These containers are made of a semi-crystalline polyethylene terephthalate (PET) for good transparency and processability properties. Such plastic containers are typically blow-molded using an injected preform. In order to reduce the price of the plastic raw material which is the cost factor of bottled water, lightweight containers have been proposed. Such lightweight containers contain less plastic and have a reduced wall thickness. For example, at least in the middle-height region of the container body the wall thickness of a lightweight container may be less than or equal to 100 μm. These lightweight containers are, therefore, manufactured with a substantially lower amount of plastic material compared to containers of similar volume content, but made using traditional processes. Accordingly, these containers are cheaper to produce and are also particularly environment-friendly.

Examples of prior art lightweight containers include those described, for example, in International Patent Application WO 2003/033361 A1 or WO 2005/04 7120 A1. These containers are known to be of generally ovoid or spherical shape, which provides for good volume/weight ratios. However, these containers also exhibit several drawbacks in that they are sometimes difficult to store and to pile in pallets for transportation.

Other geometries of lightweight container are known and disclosed from document US 2009/321386 A1 or from document WO 2013/085919 A1.

As presented, there is a big interest in light weighting plastic containers and since decades, the weight of plastic bottles is constantly decreasing due to optimized geometry and reduced processing tolerances.

However, the weight reduction results in challenges as the lightweight container should be able to withstand different environmental factors encountered during manufacturing, shipping and retail shelf stocking or storage and many of the lightweight containers on the market are not always resisting to these environmental factors.

One example of the above mentioned challenge is to avoid local container deformation during transportation leading to a deformed container and thus quality issue and consumer complaints.

In fact, during transportation, the containers may be stacked one on top of the other during packaging, shipping and display. Thus, the containers should be constructed and manufactured so as to withstand the various compressive forces applied by one or more filled containers placed on top of the container without buckling.

Additionally, in lightweight containers, the sides of the container body are very flexible and a risk exists that once the container is open, the contents splash out of the container when grabbed or squeezed by the consumer.

Accordingly, a need exists for a lightweight fluid container having improved structural features as well as desirable aesthetic characteristics. In particular, the proposed container should withstand logistic conditions and especially loads applied during transportation.

SUMMARY OF THE INVENTION

In this respects, the invention provides a container having a longitudinal axis comprising at least one undulating bead according to Claim 1.

Hence, in addition to a neck portion, a shoulder portion connected to the neck portion, a body portion comprising a label portion and a grip portion and connected to the shoulder portion via a first connecting portion, in which the label portion and the grip portion being connected together via a second connection portion, and a base portion forming the bottom of the container connected to the body portion via a third connecting portion, the grip portion of the proposed container comprises at least one undulating bead.

The use of at least one undulating bead makes it possible to provide different distribution of stresses when top load and/or compression applies on the container.

Advantageously, the grip portion comprises at least two non-adjoining undulating beads to further participate in the stress distribution.

More particularly, the grip portion comprises a combination of non-adjoining straight and undulating beads.

It is to be noted that the proposed combination of non-adjoining straight and undulating beads improves the distribution of stresses and therefore the overall resistance of the container during transportation.

According to a possible feature, the grip portion comprises at least two spaced undulating beads) and at least one straight bead. Said beads are circular and allow avoiding centralized deformation at the location of the grip portion of the container.

According to one possible feature, the at least undulating beads are separated by at least one straight bead that is not adjoining with the undulating beads.

This allows a further increased resistance of the container.

By way of example in the proposed embodiment, the beads of the grip portion comprise a constant height and a constant base width and a constant top width. Hence with a simple geometry of the bead allowing an easy process it is possible to obtain a container with improved deformation repartition.

In particular, as proposed in the disclosed embodiment, the beads are approximately hemi-spherical. This allows to have an easier handling with smooth gripping.

According to a further feature the beads have the same diameter.

Additionally, the grip portion further comprises at least one rib to further bring some flexibility in the grip portion.

As proposed in the disclosed embodiment, the label portion defines a label portion perimeter that is substantially perpendicular to the longitudinal axis and comprises a plurality of ribs positioned substantially along the perimeter of the label portion. The plurality of ribs bring a certain flexibility to the container.

In the label portion, the plurality of ribs have a constant width and a constant depth.

This is advantageous in that it improves side load resistance.

Furthermore, the grip portion is connected to the label portion via the second connecting portion comprising at least one transitional rib.

The claimed container comprises a volume comprised between 0.20 to 2 L and is a lightweight container.

BRIEF DESCRIPTION OF THE DRAWINGS

The invention is further described with reference to the following examples. It will be appreciated that the invention as claimed is not intended to be limited in any way by these examples.

Embodiments of the present invention will now be described, by way of examples, with reference to the accompanying figures in which.

DETAILED DESCRIPTION

Figure 1:
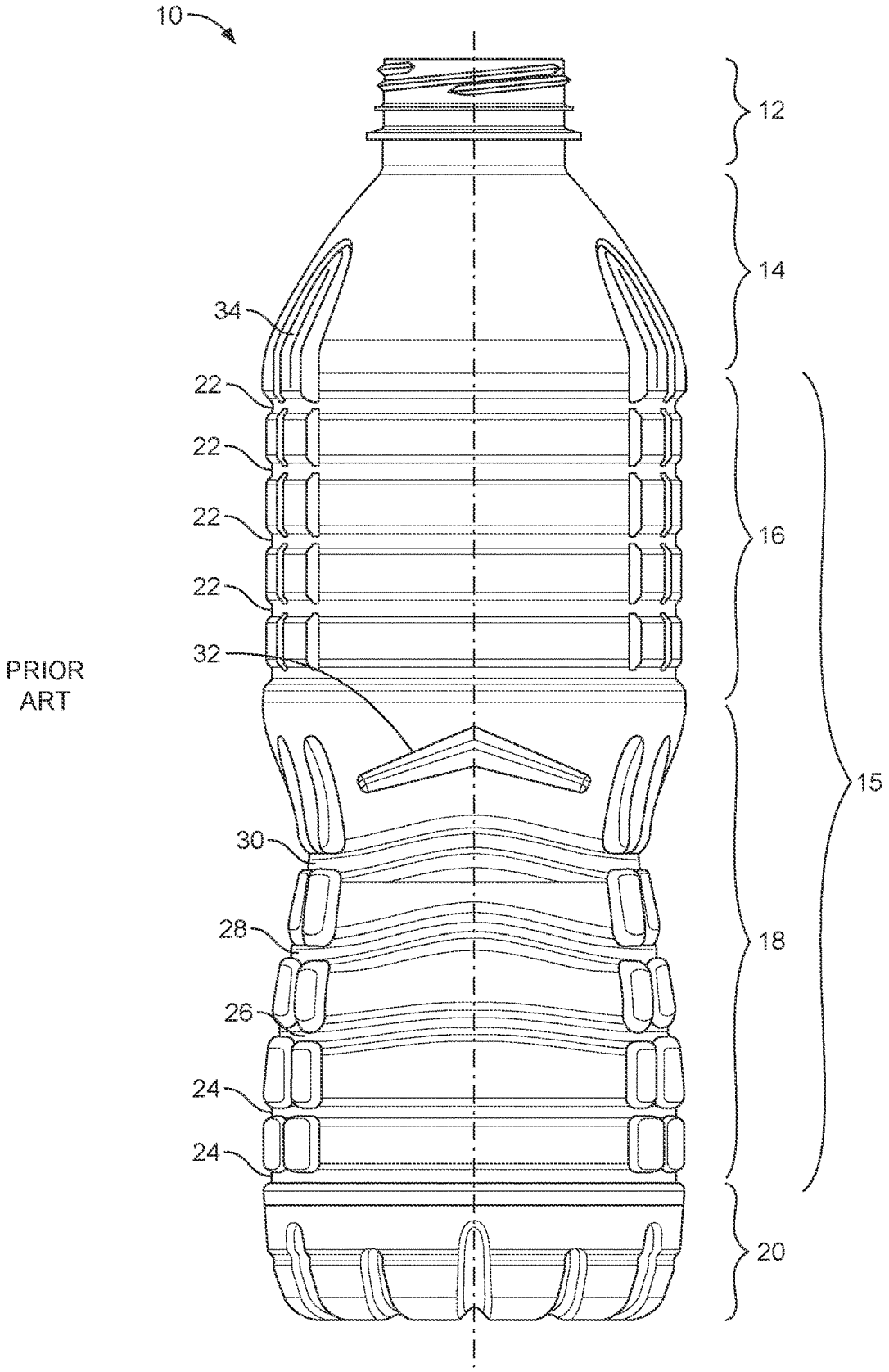
FIG. 1 is a front plan view of a prior art container.

In the following detailed description, reference is made to the accompanying drawings, which form a part hereof. In the drawings, similar symbols and references typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and make part of this disclosure.

As used in this specification, the words "comprises", "comprising", and similar words, are not to be interpreted in an exclusive or exhaustive sense. In other words, they are intended to mean including, but not limited to.

Any reference to prior art documents in this specification is not to be considered as an admission that such prior art is widely known or forms part of the common general knowledge in the field.

In particular, disclosed herein are articles, including preforms, bottles and containers, which utilize an optimized quantity of plastic in their construction while maintaining the ease of processing and excellent structural properties associated with current commercial designs.

The present invention will be described in connection with a container, for example, a bottle.

The present disclosure relates to lightweight, stable, load-bearing containers for providing consumable products and, in particular, fluids. The containers are constructed and arranged to be stable and load-bearing to provide a container having not only improved structural features, but also desirable aesthetics.

When speaking about lightweight container, it should be understood containers having a reduced quantity of thermoplastic.

For example, it is considered that a container made of PET is a lightweight container if for a volume of 50 cl, it contains between 6 to 12 g of PET, for a container having a volume of 1l, the container will contain between 15 and 19 g of PET.

For a container made by blow molding of a preform, this definition implies that the thickness of the container's walls is reduced. This reduction can lead to containers having wall thickness, in the body portion, below 100 μm.

As described above, lightweight containers for housing liquids are known to have problems transmitting vertical loads efficiently and resisting to side loads. Specifically, during packaging, distribution and retail stocking, containers or bottles can be exposed to large amounts of top-loading and can buckle at any existing points of weakness on the container. Indeed, top-loading, as well as side-loading, can be especially problematic for lightweight containers.

Additionally, due to the generally cylindrical shape of known containers, the sides of the container body are very flexible and a risk exists that once the container is open, the contents splash out of the container when grabbed or squeezed by the consumer.

Further, during packaging, distribution, and retail stocking, containers can be exposed to widely varying temperature and pressure changes, as well as external forces that jostle and shake the container. These types of environmental factors can contribute to rises in internal pressure that affect the overall quality of the product purchased by the consumer of can lead to specific load compression during transportation.

A prior art container 10 is illustrated by FIG. 1. Container 10 includes a neck portion 12, a shoulder portion 14, body portion 15 and a base portion 20. The body portion 15 is connected to base 20 and shoulder 14 portions.

Shoulder portion 14 includes at least one integrally formed shapes 34 oriented substantially vertically on shoulder portion 14.

The body portion 15 comprises a label portion 16 and a grip portion 18, each provided with a structure of reinforcing ribs.

In more detail, Label portion 16 includes several ribs 22 that traverse a circumference of the container and have constant width and depth.

Grip portion 18 presents a reduced diameter with a substantially arc-shaped along a side wall of container 10 that is parallel to a vertical axis of container 10. Grip portion 18 further includes two ribs 24 of constant width and depth, as well as one rib 26 having a first curvature, one rib 28 having a second curvature that is greater than the first curvature, and one rib 30 having a third curvature that is greater than the second curvature. Grip portion 18 is also substantially V-shaped along a side wall of container 10 that is parallel to a vertical axis of container 10, with rib 30 being the vertex of the V-shape. Container 10 further includes an integrally formed shape 32 on an upper, transition portion of the grip portion 18. Although container 10 includes ribs, container 10 may not necessarily be configured to deliver optimized stability or optimized side- and top-load resistance for a lightweight container.

Indeed, transport simulations applying compression test show that the deformations and stresses that apply on the bottle during transportation are mainly concentrated on the rib 30 of grip portion 18 and on the integrally formed shapes 34 oriented substantially vertically on shoulder portion 14. This leads to an important concentration of deformation of the bottle at this specific locations and especially at the location of the grip portion when top load is applied. This will be discussed in more details in connection with FIG. 7*a*.

As used herein, "grip portion" may be used interchangeably with "prehension portion" or "grabbing portion". As used herein, "prehension", "grabbing" or "handling" means the act of taking hold, seizing or grasping. Accordingly, a prehension portion, or grip portion, of the container may be a portion of the container intended for seizing or grasping by the consumer during handling of the container.

In contrast, Applicants have surprisingly found that the configuration of the containers disclosed herein provides improved stability, improved side-load resistance.

In this regard, the proposed geometry of the container's grip portion allows different distribution of the deformation of the container under compression test.

Figure 2A:
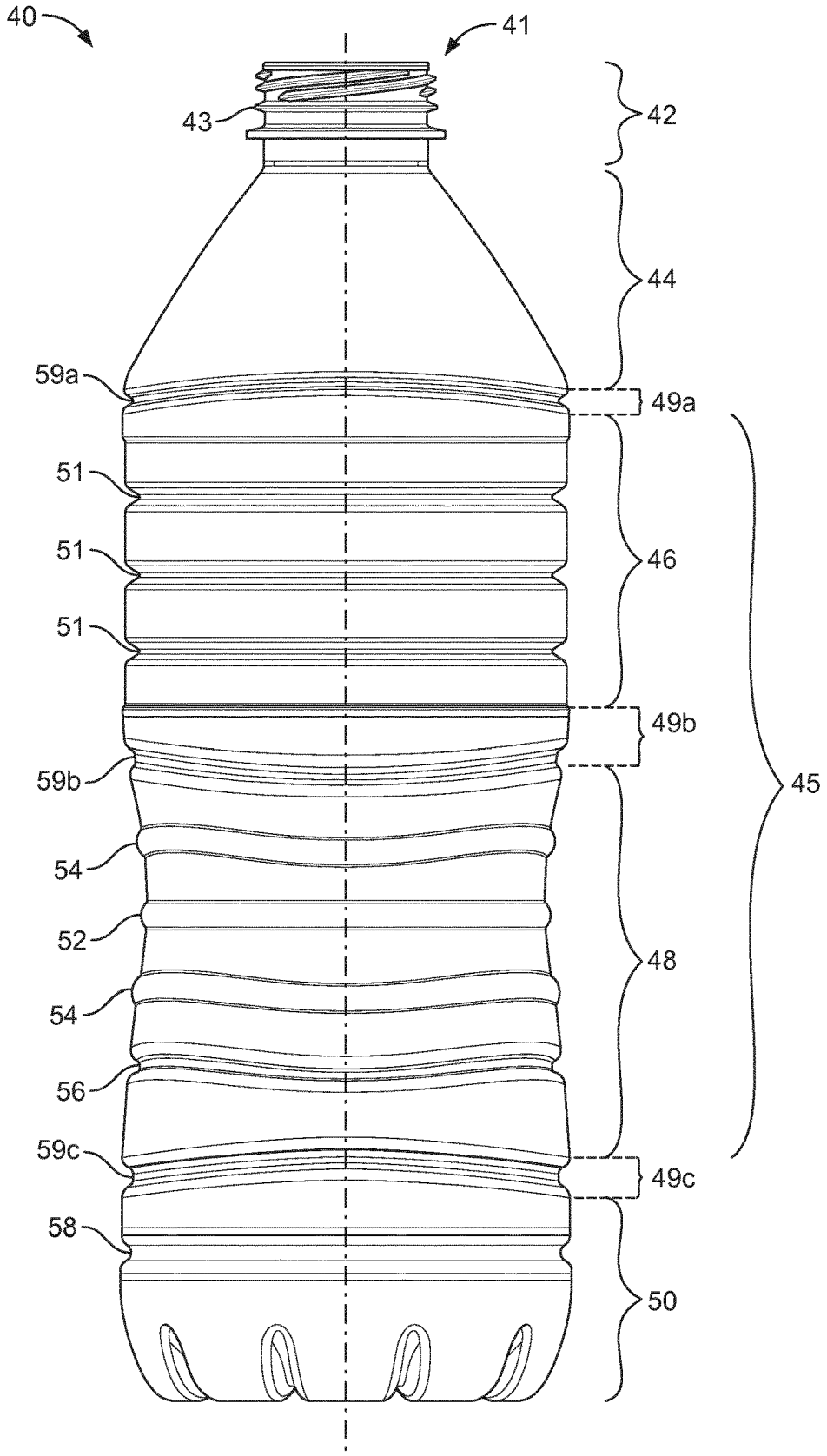
FIG. 2*a* is a front plan view of a container in an embodiment of the present invention.
Figure 2B:
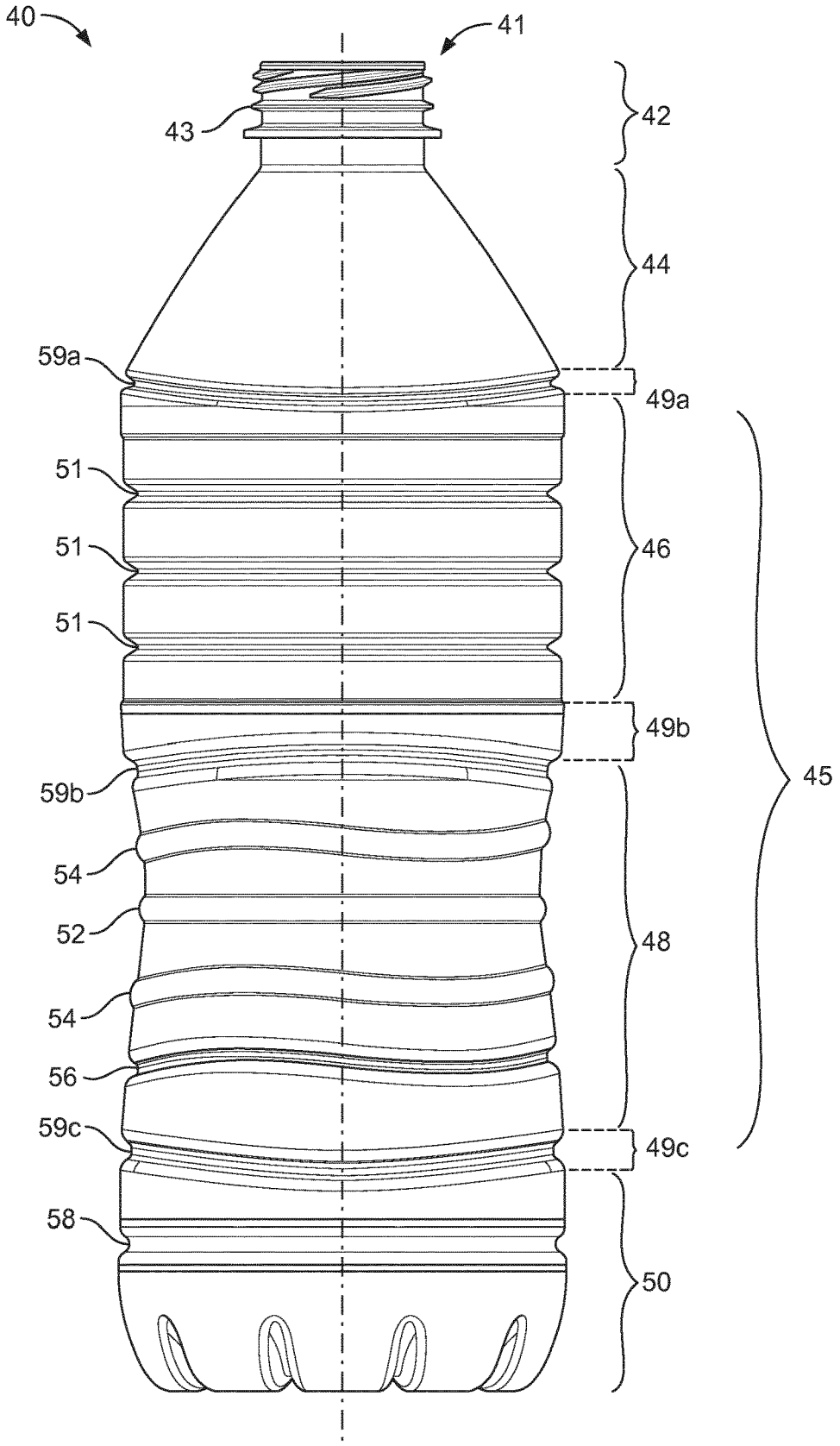
FIG. 2*b* is a side plan view of the container of FIG. 2*a* in an embodiment of the present invention.

As shown in FIGS. 2*a* and 2*b*, container 40 of the present disclosure includes a mouth 41, a neck portion 42, a shoulder portion 44, a body portion 45 and a base portion 50, all of which combine to form an interior of container 40 that is capable of housing a liquid.

Body portion 45 is connected to the shoulder portion 44 via a first connecting portion 49*a* and to the base portion 50 via a second connecting portion 49*b*.

Body portion 45 comprises a label portion 46 and a grip portion 48. Label portion 46 comprises multiple ribs 51. Grip portion 48 comprises a series of circular beads 52, 54 and ribs 56.

FIG. 2*a* illustrates a front view of the container 40 and FIG. 2*b* illustrates a side view of container 40 of the present disclosure. As can be seen from the figures, the difference between the side (FIG. 2*b*) and front (FIG. 2*a*) views of container 40 lies in grip portion 48 and in the connecting portion 49*a*, 49*b* and 49*c* of the container due to the specific shapes of the beads and ribs of the grip portion 48 and of the ribs of the connecting portions 49*a*, 49*b* and 49*c*.

Containers of the present disclosure may be configured to house any type of liquid therein. In an embodiment, the containers are configured to house a consumable liquid such as, for example, water, an energy drink, a carbonated drink, tea, coffee, milk, juice, etc. In an embodiment, the containers are configured to house water.

Containers 40 may hold any suitable volume of a liquid such as, for example, from about 200 to 2000 mL including 200 mL, 250 mL, 300 mL, 450 mL, 500 mL, 600 mL, 750 mL, 800 mL, 900 mL, 1000 mL, 1500 mL, 2000 mL, and the like. In an embodiment, containers 40 are configured to hold about 500 mL of a liquid.

Suitable materials for manufacturing containers of the present disclosure can include, for example, polymeric materials. Specifically, materials for manufacturing bottles of the present disclosure can include, but are not limited to, polyethylene ("PE"), low density polyethylene ("LDPE"), high density polyethylene ("HDPE"), polypropylene ("PP"), polyethylene furanoate ("PEF") or polyethylene terephthalate ("PET").

Further, the containers of the present disclosure can be manufactured using any suitable manufacturing process such as, for example, conventional extrusion blow molding, stretch blow molding, injection stretch blow molding, and the like.

Mouth 41 may be any size and shape known in the art so long as liquid may be introduced into container 40 and may be poured or otherwise removed from container 40. In an embodiment, mouth 41 may be substantially circular in shape and have a diameter ranging from about 10 mm to about 50 mm, or about 15 mm, 20 mm, 25 mm, 30 mm, 35 mm, 40 mm, 45 mm, or the like. In an embodiment, mouth 41 has a diameter that is about 22 mm.

Neck portion 42 may also have any size and shape known in the art so long as liquid may be introduced into container 40 and may be poured or otherwise removed from container 40. In an embodiment, neck portion 42 is substantially cylindrical in shape having a diameter that corresponds to a diameter of mouth 41. The skilled artisan will appreciate that the shape and size of neck portion 42 are not limited to the shape and size of mouth 41. Neck portion 42 may have a height (from mouth 41 to shoulder portion 44) from about 5 mm to about 45 mm, or about 10 mm, 15 mm, 20 mm, 25 mm, 30 mm, 35 mm, 40 mm, or the like. In an embodiment, neck portion 42 has a height of about 11 mm.

Container 40 can further include an air tight cap (not represented) attached to neck portion 42. The cap can be any type of cap known in the art for use with containers similar to those described herein. The cap may be manufactured from the same or a different type of polymeric material as container 40, and may be attached to container 40 by re-closeable threads, or may be snap-fit, friction-fit, etc. Accordingly, in an embodiment, cap includes internal threads (not shown) that are constructed and arranged to mate with external threads 43 of neck portion 42.

Shoulder portion 44 of container 40 extends from a bottom of neck portion 42 downward to a top of label portion 46. Shoulder portion 44 comprises a shape that is substantially a conical frustum. As used herein, a "conical frustum" means that shoulder portion 44 has a shape that very closely resembles a cone having a top portion (e.g., the apex) of the cone lopped-off. Shoulder portion 44 has a lopped-off apex since shoulder portion 44 tapers into neck portion 42 for functionality of container 40. Further, the "conical frustum" shape also includes a rounded edge 47 wherein shoulder portion 44 curves downward in a substantially vertical orientation to meet label portion 46.

Shoulder portion 44 may have a height (from a bottom of neck portion 42 to a top of label portion 46) ranging from about 30 mm to about 70 mm, or about 35 mm, 40 mm, 45 mm, 50 mm, 55 mm, 60 mm, 65 mm or the like. In an embodiment, shoulder portion 44 has a height that is about 40 mm.

At a bottom portion (e.g., before label portion 46), shoulder portion 44 may have a diameter ranging from about 50 mm to about 75 mm, or about 50 mm, 55 mm, 60 mm, 65 mm, 70 mm, or the like. In an embodiment, the diameter of a bottom, widest portion of shoulder portion 44 is about 66 mm.

Shoulder portion 44 is connected to label portion 46 via a first connecting portion 49*a*. Said connecting portion 49*a* comprises a rib 59*a*. In the present case, rib 59*a* of the first connecting portion 49*a* is a rib having a curved shape as can be seen on FIGS. 2*a* and 2*b*. The rib 59*a* has constant width (W) (outside width at the surface of the container, also defined as WO) and depth (D) as there is no increase or decrease in width and in depth as the rib traverses the circumference of the container 40.

As proposed, rib 59*a* has a curved shape that provides a spring effect allowing for increase of pressure within the container, which is typical, for example, during storage and transport of lightweight, liquid-filled containers.

Figure 4:
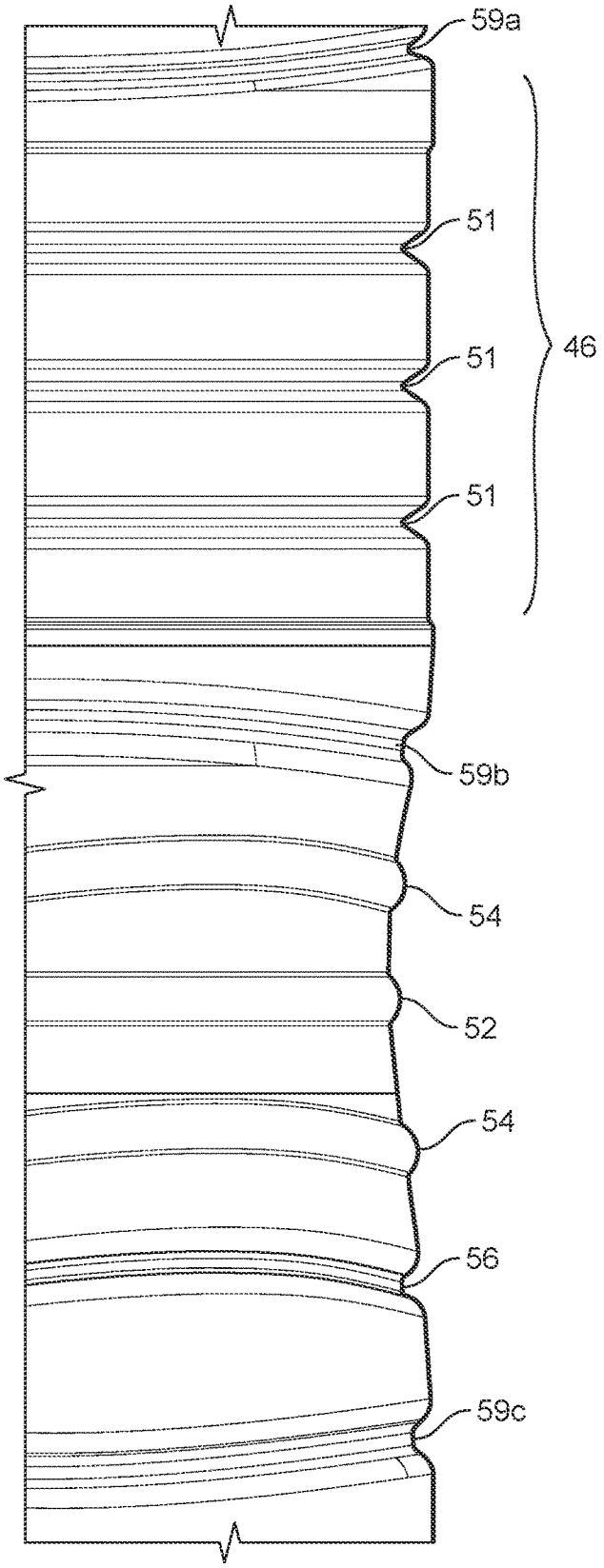
FIG. 4 is a partial detailed view of the body portion of the container of FIG. 2*a* of the present invention.

Label portion 46 of container 40 includes a plurality of ribs 51 having a constant width (W) and depth (D), as shown more clearly in FIG. 4. In this regard, ribs 51 have a constant width because the ribs do not increase or decrease in width as the ribs traverse the circumference of container 40. Ribs 51 have a constant depth because the ribs do not change the distance between an inner most portion of the rib and an adjacent portion of an outer wall of container 40 as the ribs traverse the circumference of container 40. Proposed ribs 51 have straight shape without any curved or arcuate portion.

Container 40 may include any number of straight and/or constant ribs 51 having any size that provides improved stability and load resistance. Container 40 may include 1, 2, 3, 4, 5, 6, 7, 8, 9 or 10 ribs 51. In an embodiment, container 40 includes a plurality of ribs 51. In another embodiment, container 40 includes 2-5 ribs 51, or 3-4 ribs 51, or 3 ribs 51. In the proposed embodiment container 40 includes 3 ribs 51.

For the ribs an internal width (WI) is defined as the width of the rib inside the rib. An outside width (WO) is also defined as the width of the rib at the surface of the container.

Ribs 51 may have an outside width from about 1 to about 5 mm, for from about 2 to about 4 mm, or about 3 mm. In an embodiment, ribs 51 have a width (outside width) that is about 3 mm. Ribs 51 may also have a depth that is from about 1 mm to about 4 mm, or from about 2 to about 3 mm. In the proposed embodiment, ribs 51 have a depth that is about 2 mm.

At a widest point of ribs 51, container 40 may have a diameter ranging from about 40 mm to about 75 mm, or about 45 mm, 50 mm, 55 mm, 60 mm, 65 mm, 70 mm, 75 mm, or the like. In the proposed embodiment, the diameter of container 40 at the widest portion of rib 51 is about 65 mm.

Cross section of ribs 51 may be of different geometry, for example, trapezoidal, triangular or hemi-spherical, but always with the aim of reinforcing the side-load resistance (i.e., lateral resistance of the container) and the top-load resistance (i.e., longitudinal resistance of the container) of the container. In the proposed embodiment, ribs 51 have a trapezoidal geometry.

Figure 5A:
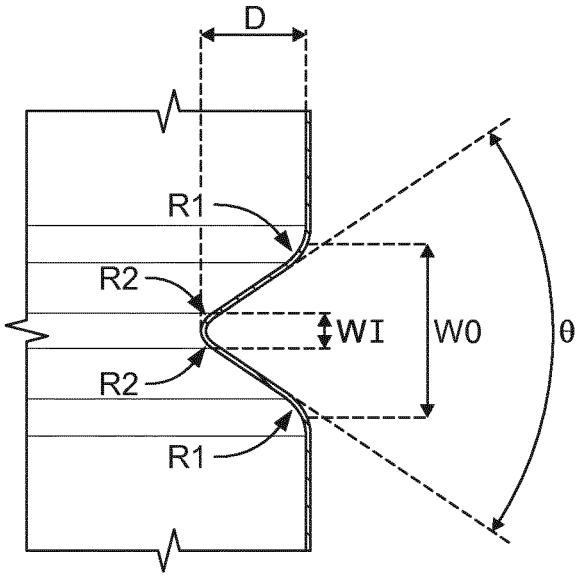
FIGS. 5*a* and 5*b* are detailed views of a rib of the label portion and of the straight bead of the embodiment of FIG. 4 of the present invention.

Additionally, ribs 51 may have a first radius of curvature, or a bend radius, where a substantially vertical side wall of container 40 curves inward to form rib 51 as can be seen in FIG. 5*a*. This radius of curvature is indicated by the arrow in combination with (R1), and is also present where a bottom portion of rib 51 curves to meet the substantially vertical side wall of container 40 located below rib 51. The two radii R1 may have similar or different values.

Ribs 51 may also include a second radius of curvature at a depth (D) of rib 51. This second radius of curvature is indicated by the arrow in combination with the (R2) indicator. The two radii R2 may have similar or different values.

In the present case, the radii of curvature (R1, R2) of ribs 51 have different values, R1 is about 1 mm and R2 is about 0.5 mm.

The geometry of a rib also defined by its opening angle θ as represented in FIG. 5*a*. In the disclosed embodiment, ribs 51 have an opening angle of about 70°.

Label portion 46 is connected to grip portion 48 via a second connecting portion 49*b*. Second connecting portion 49*b* comprises a rib 59*b*. In the present case, rib 59*b* of the second connecting portion 49*b* is a rib having a curved shape as can be seen on FIGS. 2*a* and 2*b*. The rib 59*b* has constant width and depth as there is no increase or decrease in width and in depth as the rib as the rib traverses the circumference of the container 40.

As proposed, rib 59*b* has a curved shape that provide a spring effect allowing for increase of pressure within the container, which is typical, for example, during storage and transport of lightweight, liquid-filled containers.

For rib 59*b*, values of R1, R2, D, WI, WO and θ may also be defined to characterize the rib, similarly as ribs 51 and 59*a*.

Second connecting portion 49*b* has a diameter that is similar to the diameter of label portion 46. The diameter of container 40 at the location of the label portion is about 65 mm. At the lower part of the second connecting portion 49*b* begins a reduction in the diameter of the container 40 leading to a diameter of the grip portion 48 that is smaller than the diameter of the label portion 46.

Indeed, in the present case grip portion 48 is locally shaped to visually define a prehension portion of the consumer and to locally reduce the diameter of the container 40 to ease gripping.

Figure 6:
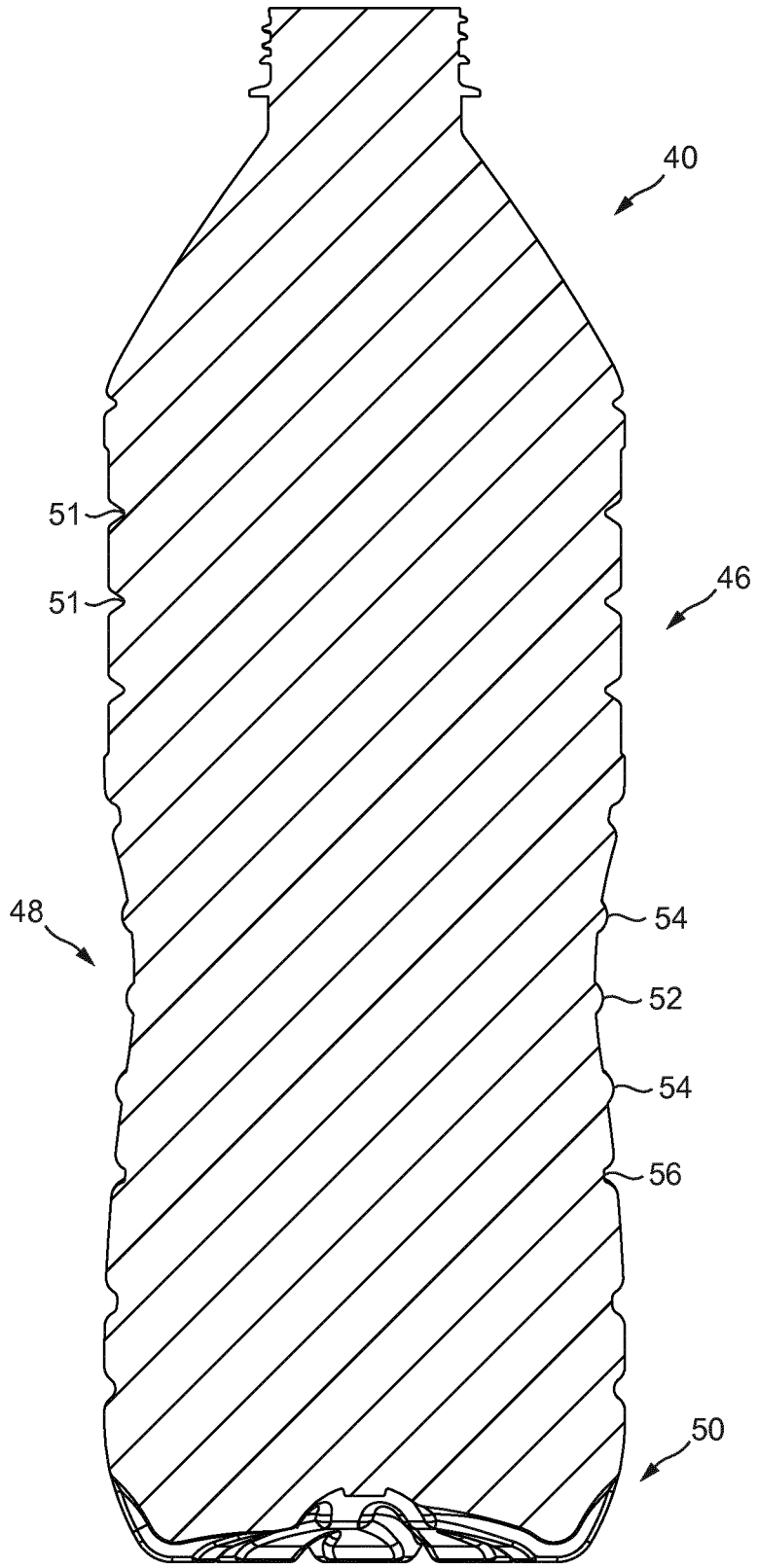
FIG. 6 is a cross-sectional view of the container of FIG. 2*a* of the present invention.

As can be seen in FIGS. 2*a* and 2*b* and from FIG. 6 presenting a cross section of FIG. 2*a*, the surface of the container body portion 45 is recessed inwards at the location of the grip portion 48 to create a portion with smaller diameter. The wall of container 40 is recessed inwards from 3 to 6 mm, meaning a reduction of the diameter of the container, at the location of the grip portion, from 6 to 12 mm.

In the middle of the grip portion 48, the diameter of the container 40 is reduced to 58.5 mm (minimum diameter of the container).

Figure 3:
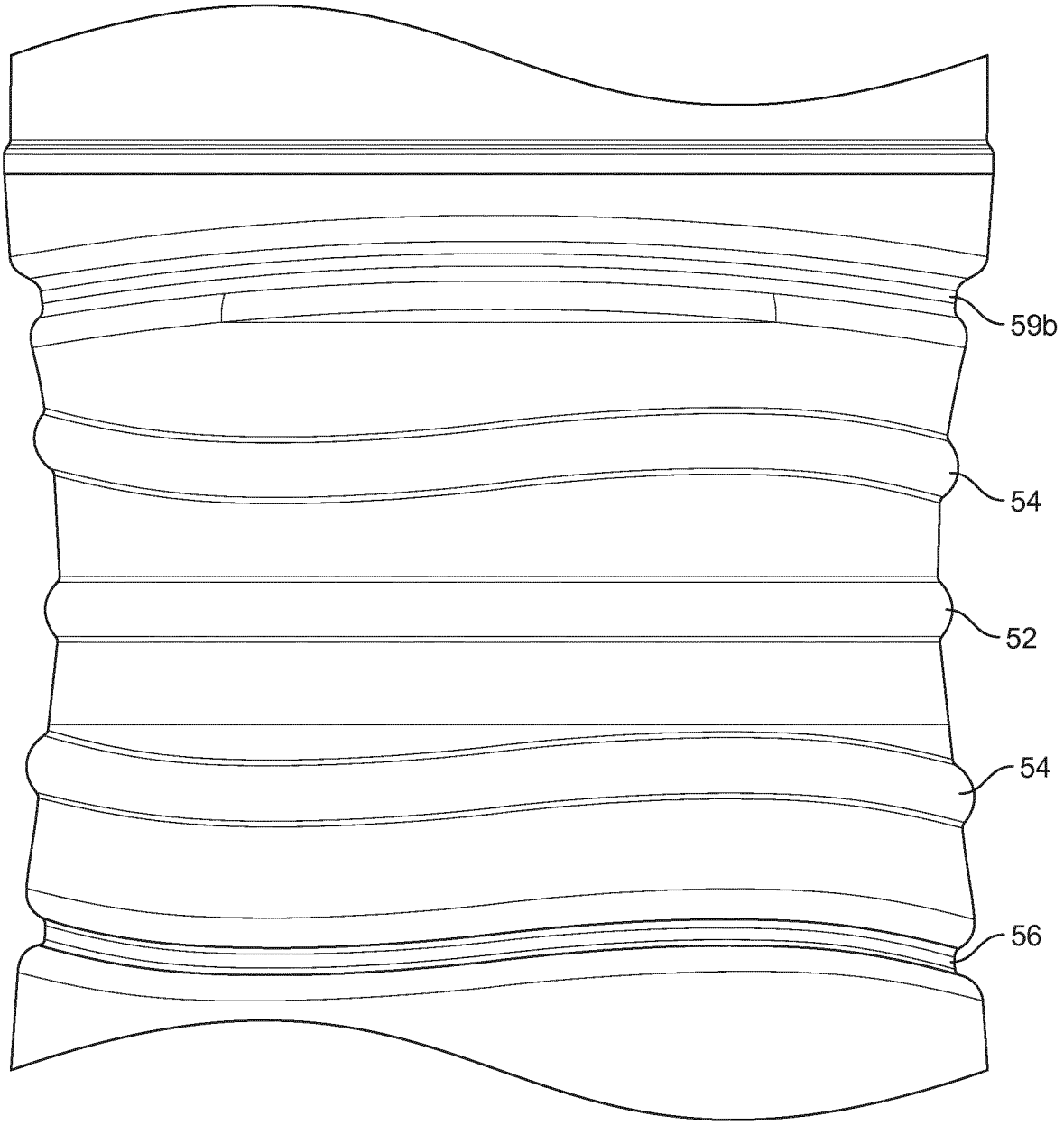
FIG. 3 is a detailed view of the container of FIG. 2*a* of the present invention at the location of the grip portion.

In the proposed embodiment and as represented in FIG. 3, the surface of the container from the lower part of the second connecting portion 49*b* to the lower part of the grip portion 18 is circularly and inwardly recessed according to an arc of a circle defined at the location of the middle of the grip portion. The arc of circle located at the location of the middle of the grip portion 48 corresponds to a circle having a radius of about 62 mm.

According to the present disclosure, grip portion 48 comprises two different structural elements to improve the mechanical properties of the proposed lightweight container 40.

The first elements are beads referenced 52, 54 in the figures. Bead may be defined as raised circumferential flange or ring presenting an embossment at the external surface of the container 40.

The second elements are ribs referenced 56 in the figures. Rib have its usual meaning (similar as the one detailed in connecting with the label portion ribs) and may be defined as circular groove extending on the perimeter of the container 40.

The beads 52, 54 and ribs 56 of the grip portion 48 traverse a circumference of the container and are used to provide added hoop strength, rigidity and resistance to bending, leaning, crumbling and/or stretching Grip portion 18 comprises two types of circular beads, straight beads and undulating beads. In the proposed container 40 and as can be seen in the figures, grip portion 48 comprises a combination of non-adjoining straight 52 and undulating 54 beads. Here, said combination comprises two spaced undulating beads 54 separated by one non-adjoining straight bead 52.

Hence, the beads 52, 54 are all separated from each other.

The proposed beads 52, 54 of grip portion 48 comprise a constant height and a constant base width and a constant top width.

The beads 52, 54 are approximately hemi-spherical in cross section. As an alternative, the beads may be of trapezoidal geometry or any other suitable geometry.

Figure 5B:
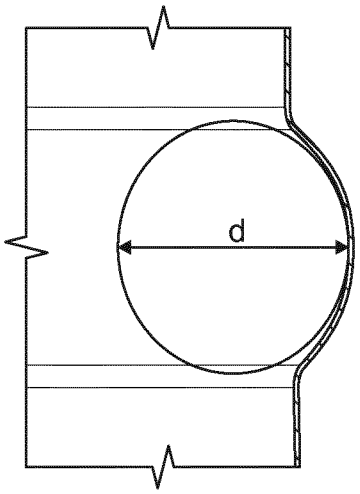

Additionally, in the proposed disclosure the beads 52, 54 have the same diameter (d). Said diameter d as well as the hemi-spherical geometry of the beads is represented in FIG. 5*b*. The height (not represented) of the bead correspond to half of the diameter d.

The diameter d of the container of the proposed embodiment is about 5 mm. However, the diameter of the beads may range from 2.5 to 7 mm and the beads 52, 54 may have different diameters.

The beads have the function of rigidifying the grip portion which brings a homogenous distribution of the deformation of the container undergoing compression and load application. This therefore increase the resistance and stability of the container.

As mentioned, grip portion 48 also comprises a rib 56. Said rib 56 is in the form of an undulating rib 56.

As used herein, "undulating" ribs/beads or the "undulation" of ribs/beads means that the ribs move in a wavy, sinuous, curved, or rising and falling manner as the ribs/beads oscillate and traverse a circumference of the present containers. Accordingly, the presently disclosed undulating ribs/beads may be described in terms of a wave. Rib/bead can also be qualified as a swirling rib/bead.

In this regard, undulating ribs/beads may have, for example, a peak-to-peak amplitude (e.g., as measured from crest to adjacent trough) and a wave period (e.g., as measured from crest to crest or from trough to trough). In an embodiment, undulating ribs/beads may have a peak-to-peak amplitude from about 1 mm to about 10 mm, or 2 mm, or 3 mm, or 4 mm, or 5 mm, or 6 mm, or 7 mm, or 8 mm, or 9 mm.

In an embodiment of the present disclosure, undulating rib 56 has a peak-to-peak amplitude of about 7 mm and undulating beads 54 has a peak-to-peak amplitude of about 7 mm. In an embodiment, undulating ribs/beads complete one to three wave periods as undulating ribs traverse a circumference of the container. In an embodiment, undulating ribs complete two wave periods as undulating ribs traverse a circumference of the container.

The proposed combination proposes a given number of undulating and straight beads, however additional undulating and straight beads may be used with the aim of improving the resistance to external loads (side and/or top loads).

Figure 7A:
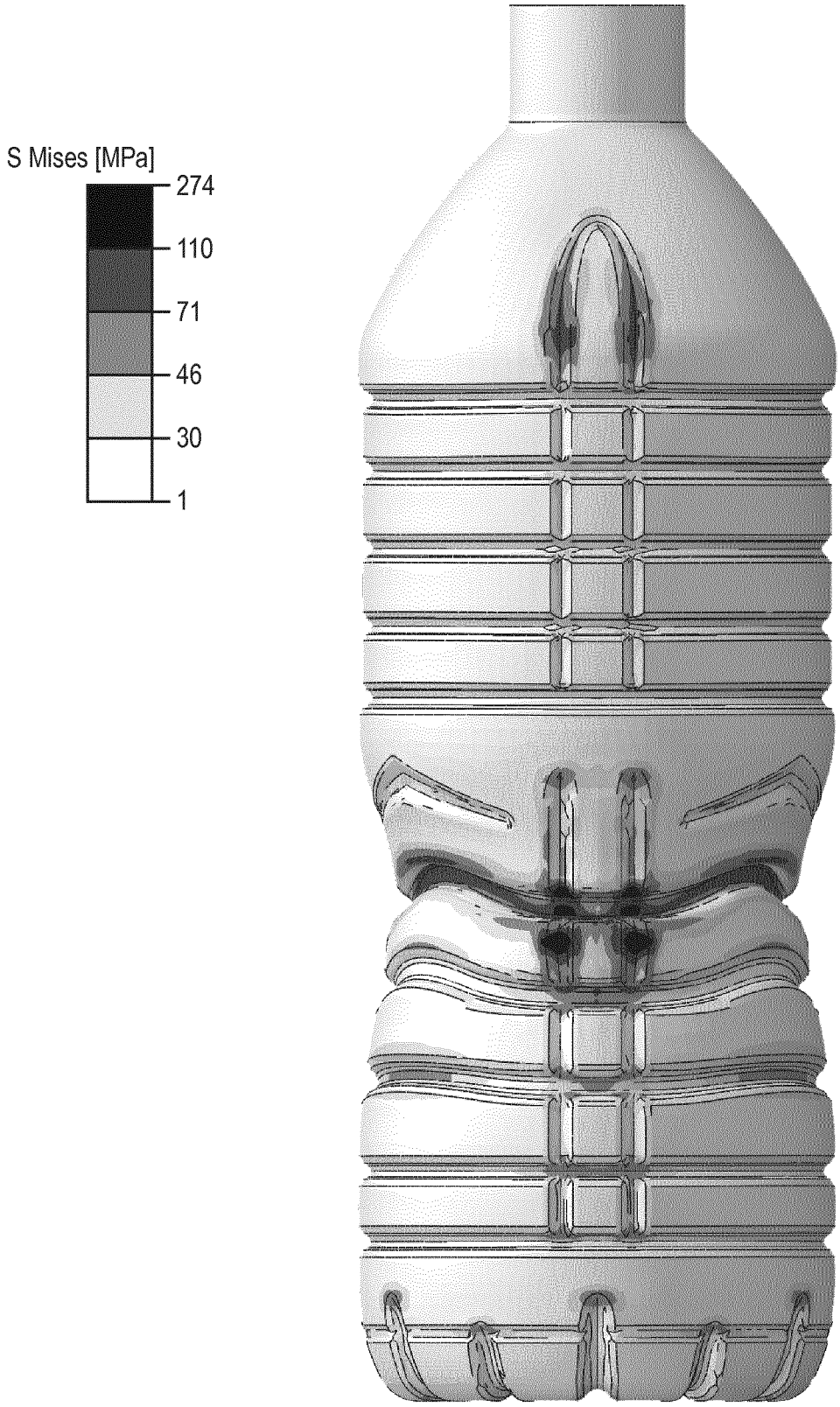
FIGS. 7*a* and 7*b* is a comparison between several containers, including the container of the present invention, presenting the stress distribution on the container during transportation.
Figure 7B:
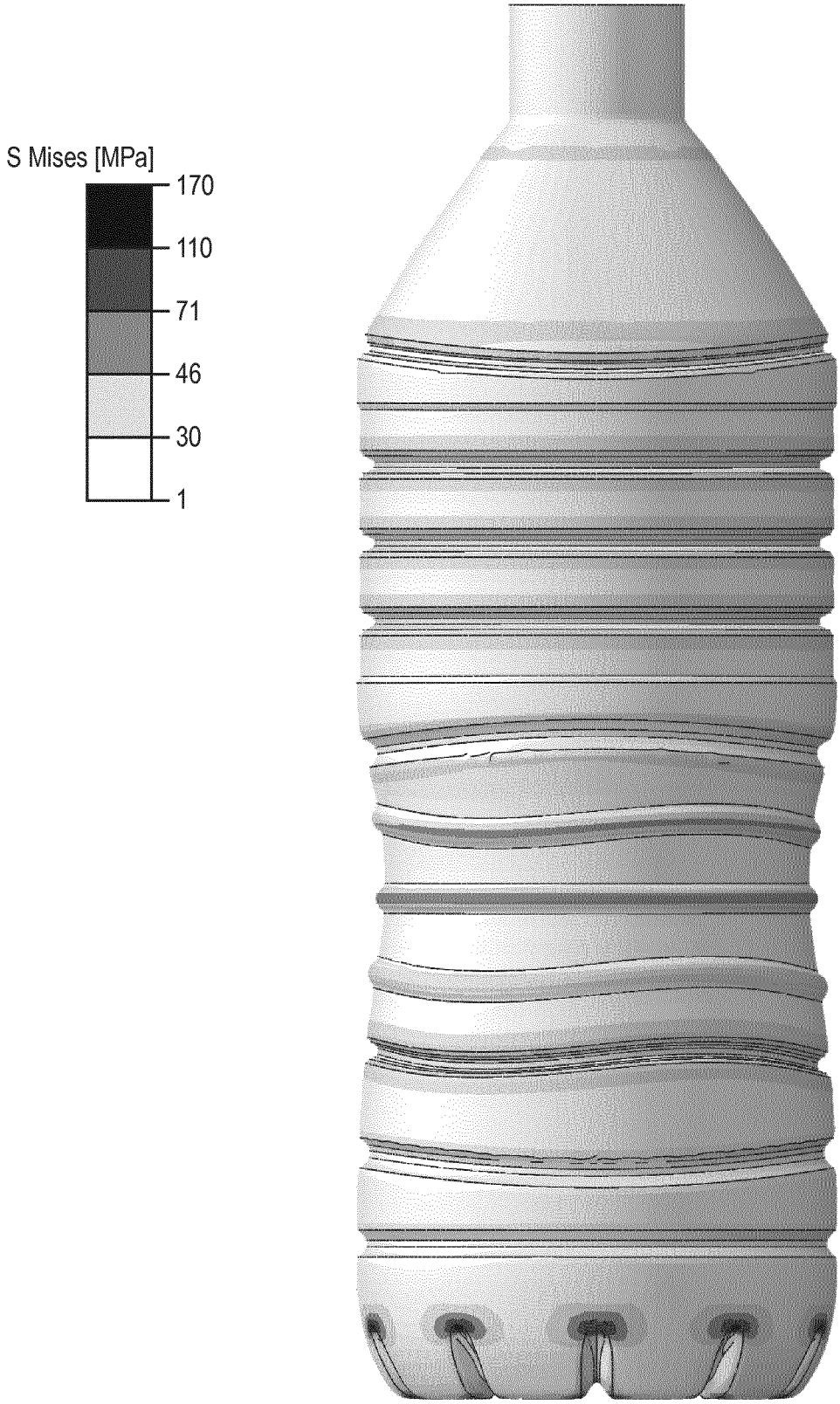

FIGS. 7*a* and 7*b* present the results of a transport simulation in which a compression test (also called top load test) is applied. The test is performed for the container of the prior art as presented in FIG. 1 and for the container of FIGS. 2*a* and 2*b* corresponding to an embodiment of the proposed invention. In the test, a compression of 5 mm is applied on the container (bottle).

The figures show a field plot (a color for every point on the bottle) which displays a representative scalar stress value at every position on the bottle (the stress value is called van Mises stress). The unity is MPa ($N/mm^2$). As can be seen, the two legends for FIGS. 7*a* and 7*b* have the same color scale. The color of the scale shows to be black above 110 MPa stress. This means that when stress above 11 MPa applies on a portion/a zone of the container, this portion/zone appears in grey to black color.

As can be seen at first sight, the stress concentration and the maximum stress value is much higher for the container of FIG. 7*a* in comparison to the container of FIG. 7*b* (274 MPa vs. 110 MPa): black color zones are more numerous on the container of FIG. 7*a* than on the container of FIG. 7*b*.

The higher the stress is on a given portion of the container, the higher the subsequent deformation at this specific portion is because a bottle as a container is almost a linear elastic system for this kind of test.

Hence, as can be seen in FIG. 7*a*, the container of the prior art concentrates the stresses and subsequent deformations at the location of the grip portion 18 and especially on the rib located in the middle of the grip portion. As most of the stresses are concentrated in a given area, the deformation will first occur at this location. The deformation will be proportional to the applying stresses.

The proposed container solution as represented in FIG. 7*b*, presents a different repartition of stress when compression and/or top load is applied on the container. Thanks to the beads located in the grip portion, there is no concentration of stress at a single location but the stress is distributed throughout the whole container. Indeed, the stress is distributed at the location of the different ribs and beads: connecting ribs, label panel ribs, grip portion rib and beads.

This new distribution of the stress applying on the container allows having a better resistance of the container to top load and compression. This means that small deformations may occur on the container but without leading to a complete deformation or breaking of the container.

This is particularly advantageous as the proposed container is a lightweight container which may be very sensible to loads applying on it.

Container 40 comprises a third connecting portion 49*c* between the grip portion 18 and the base portion 50. In the proposed disclosure, the third connecting portion 49*c* comprises a rib 59*c* having a curved shape as can be seen on FIGS. 2*a* and 2*b*. The rib 59*c* has constant width (W) and depth (D) as there is no increase or decrease in width and in depth as the rib as the rib traverses the circumference of the container 40.

As proposed, rib 59*c* has a curved shape that provide a spring effect allowing for increase of pressure within the container, which is typical, for example, during storage and transport of lightweight, liquid-filled containers.

The bottom portion of container 40 comprises base portion 50, which may be of any suitable design, including those known in the art and as illustrated. Importantly, however, base portion 50 of the present containers includes a base rib 58, which is an opened trapezoidal rib that helps to ensure good rigidifying structure of the container. Although the present disclosure depicts base portion 50 as having one rib 58, the skilled artisan will appreciate that base portion 50 may include more or less than one rib 58 so long as the container is able to provide the desired stability and improved side- and top-load resistance.

In the present embodiment, rib 58 has constant width (W) and constant depth (D). The width may be about 2.5 to about 6.5 mm and the depth from about 0.5 mm to about 2.5 mm. In the proposed embodiment width of rib 56 is about 5.5 mm and depth of rib 58 is about 1.5 mm.

Additionally, and similarly as for ribs 51 of the label portion 46, rib 58 of base portion 50 may have a first radius of curvature, or a bend radius, where a substantially vertical side wall of container 40 curves inward to form rib 58. This radius of curvature is also present where a bottom portion of rib 58 curves to meet the substantially vertical side wall of container 40 located below rib 58. The two first radius of curvature of rib 56 may be around 0.5 to 3 mm and may be identical or different in terms of value.

Rib 58 may also include a second radius of curvature at a depth (D) of rib 58 where inwardly first curved radius meets a substantially vertical inner portion of rib 58, which is also present where the substantially vertical inner portion of rib 58 curves outward toward first radius located at a bottom of rib 58. The two second radius of curvature of rib 58 may be around 0.5 to 1.5 mm and may be identical or different in terms of value.

Additionally, the containers of the present disclosure can also improve the ease of use and handling by manufacturers, retails and consumers using lightweight containers. In this regard, the structural features described herein provide for improved stability and improved side-loading resistance to help achieve a container that is desirable by consumers.

Although the invention has been described by way of example, it should be appreciated that variations and modifications will be apparent to those skilled in the art and may be made without departing from the scope of the invention as defined in the claims. Furthermore, where known equivalents exist to specific features, such equivalents are incorporated as if specifically referred in this specification.

The invention claimed is:

1. A container presenting a longitudinal axis, the container comprising:

a neck portion, a shoulder portion connected to the neck portion, a body portion comprising a label portion and a grip portion, the body portion being connected to the shoulder portion via a first connecting portion, the label portion and the grip portion being connected together via a second connecting portion, and a base portion forming the bottom of the container, the base portion being connected to the body portion via a third connecting portion, wherein the grip portion comprises a combination of at least one non-adjoining straight bead and at least one circular undulating bead, wherein the at least one non-adjoining straight bead and the at least one circular undulating bead each comprise a raised circumferential ring presenting an embossment on an external surface of the container, and wherein the at least one circular undulating bead of the grip portion comprises a constant height, a constant base width, and a constant top width; and wherein a middle-height region of the container has a wall thickness of below 100 μm.

2. The container according to claim 1, wherein the grip portion comprises at least two non-adjoining undulating beads.

3. The container according to claim 1, wherein the grip portion comprises at least two spaced circular undulating beads and at least one straight bead.

4. The container according to claim 3, wherein the at least two spaced circular undulating beads are separated by at least one straight bead that is not adjoining with the undulating beads.

5. The container according to claim 1, wherein the at least one circular undulating bead is approximately hemi-spherical.

6. The container according to claim 2, wherein, the at least two non-adjoining undulating beads have the same diameter.

7. The container according to claim 1, wherein the grip portion further comprises at least one rib.

8. The container according to claim 1, wherein the label portion defines a label portion perimeter that is substantially perpendicular to the longitudinal axis and comprises a plurality of ribs positioned substantially along the perimeter of the label portion.

9. The container according to claim 8 wherein the plurality of ribs of the label portion have a constant width and a constant depth.

10. The container according to claim 1, wherein the second connecting portion comprises at least one transitional rib.

11. The container according to claim 1, comprising a volume comprised between 0.20 to 2 L.

12. The container according to claim 1, wherein the first connecting portion comprises a first rib, the second connecting portion comprises a second rib, and the third connecting portion comprises a third rib, and each of the first rib, the second rib, and the third rib has a curved shape.

13. The container according to claim 1, wherein the base portion includes a base rib having a trapezoidal geometry.

14. The container according to claim 4, wherein the grip portion further comprises at least one rib, and wherein the at least one rib is between one of the at least two spaced circular undulating beads and the third connecting portion.

15. The container according to claim 1, wherein the container comprises an overall curvature of the grip portion defined by a surface of the container from a lower part of the second connecting portion to a lower part of the grip portion, and the surface is circularly and inwardly recessed according to an arc of a circle defined at a middle of the grip portion.

* * * * *